US005158031A

United States Patent [19]

Arnett et al.

[11] Patent Number: 5,158,031

[45] Date of Patent: Oct. 27, 1992

[54] BALLAST TANK ELEMENTS FOR A DOUBLE HULL VESSEL

[75] Inventors: Dennis Arnett, Napa; R. Stewart Young, San Rafael, both of Calif.

[73] Assignee: Chevron Research and Technology Co., San Francisco, Calif.

[21] Appl. No.: 728,863

[22] Filed: Jul. 11, 1991

Related U.S. Application Data

[63] Continuation of Ser. No. 519,386, May 4, 1990, abandoned.

[51] Int. Cl.[5] ..... B63B 39/03

[52] U.S. Cl. ..... 114/125; 114/74 R

[58] Field of Search ..... 114/72, 73, 74 T, 74 R, 114/74 A, 78, 79 R, 121, 125

[56] References Cited

U.S. PATENT DOCUMENTS

| | | | |
|---|---|---|---|
| 3,021,808 | 2/1962 | Henry | 114/74 A |
| 3,209,715 | 10/1965 | Campbell et al. | 114/74 R |
| 3,326,167 | 6/1967 | Paoli | 114/74 A |
| 3,631,832 | 1/1972 | Rodriguez | 114/74 R |
| 3,745,960 | 7/1973 | Devine | 114/74 R |
| 4,030,438 | 6/1977 | Telfer | 114/74 |

FOREIGN PATENT DOCUMENTS

| | | | |
|---|---|---|---|
| 0766955 | 10/1980 | U.S.S.R. | 114/74 R |
| 1302476 | 4/1971 | United Kingdom . | |

*Primary Examiner*—Ed Swinehart

*Attorney, Agent, or Firm*—E. A. Schaal; E. J. Keeling

[57] ABSTRACT

A double hull vessel is disclosed having a novel type of ballast tank element. That ballast tank element has a half-breadth double-bottom ballast tank and a side ballast tank. The half-breadth double-bottom ballast tank has a tank access trunk that is located within the double-side hull. Preferably, that tank access trunk is at least one frame space wide. The side ballast tank is located within the double-hull, and is adjacent to the tank access trunk. Preferably, the ballast tank elements are used in pairs which are adjacent and opposite from each other. These pairs of ballast tank elements can be used in conjunction with double-hull ballast tank elements having no internal subdivisions.

3 Claims, 7 Drawing Sheets

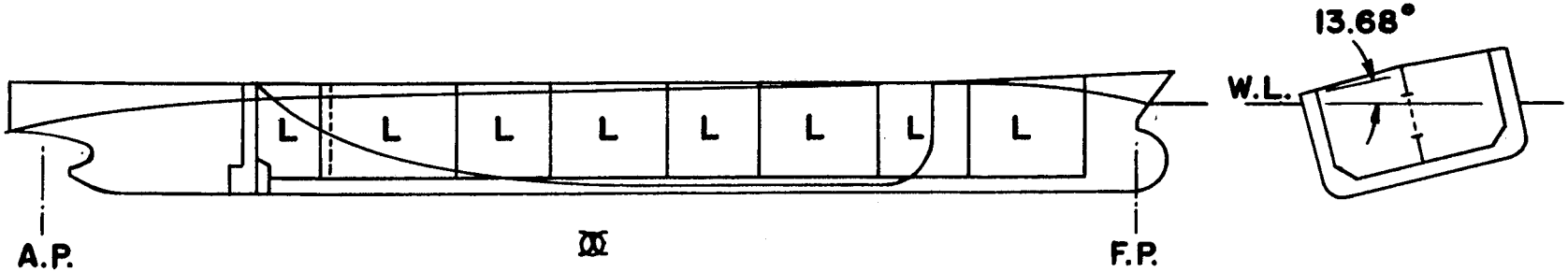
FIG_2(a)
FIG_2(b)
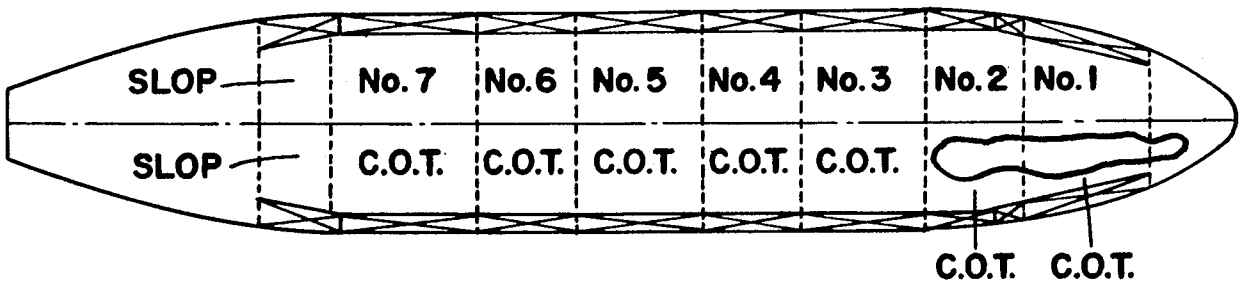
FIG_2(c)
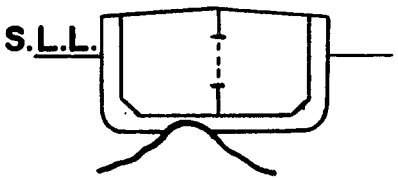
FIG_2(d)

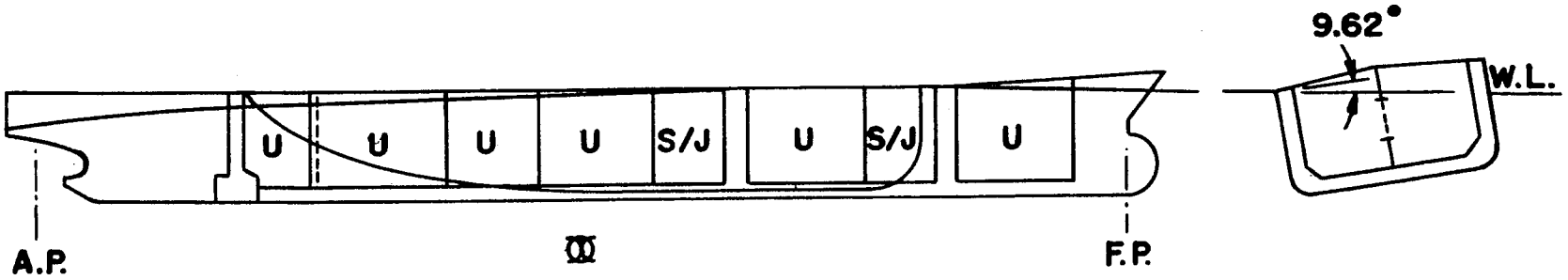
FIG_3(a)
FIG_3(b)
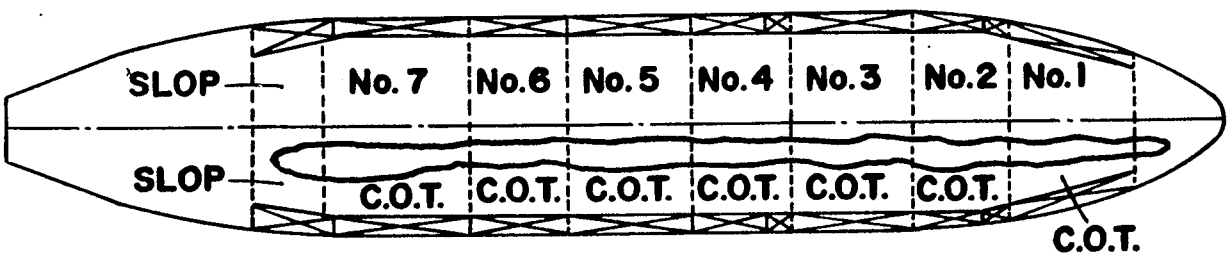
FIG_3(c)
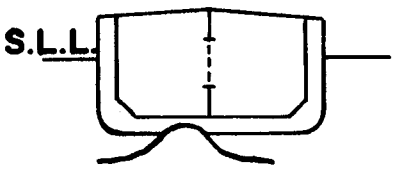
FIG_3(d)

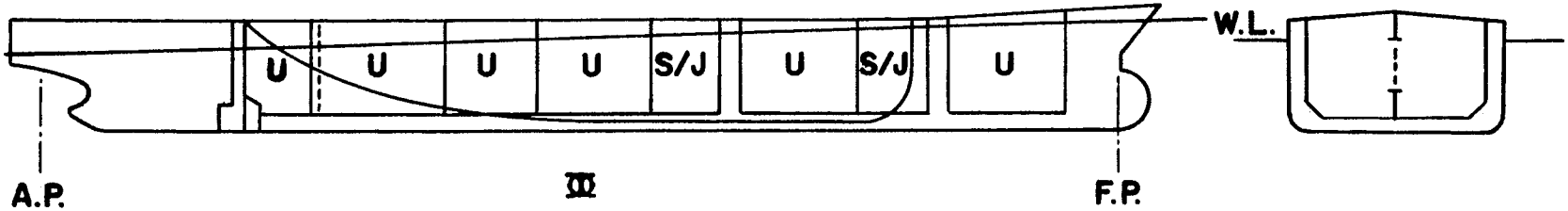
FIG_4(a)
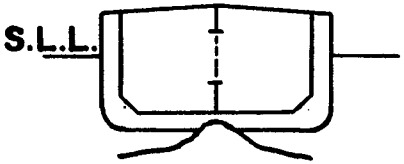
FIG_4(b)
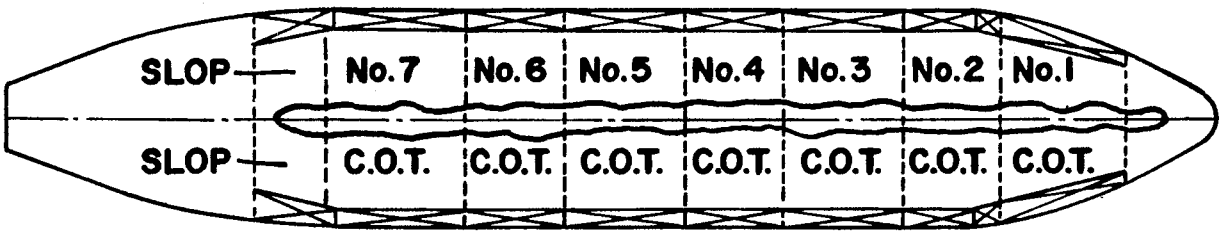
FIG_4(c)
FIG_4(d)

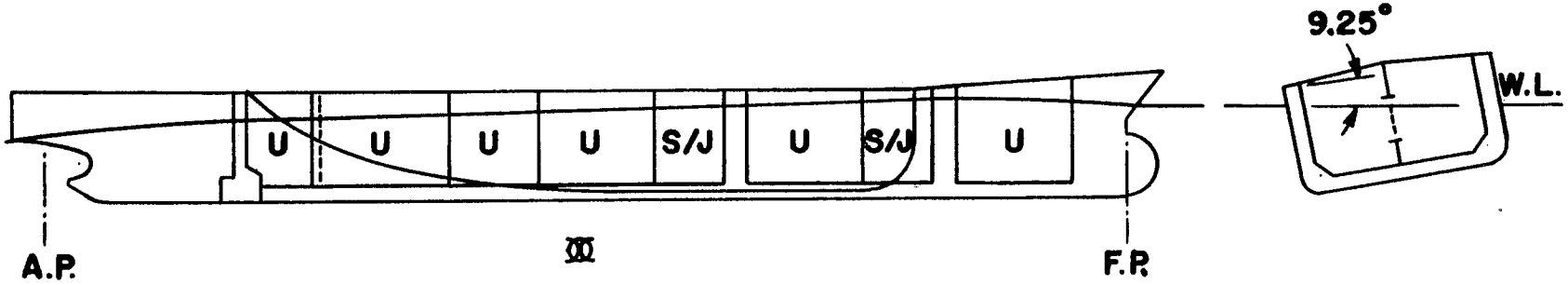
FIG_5(a)
FIG_5(b)
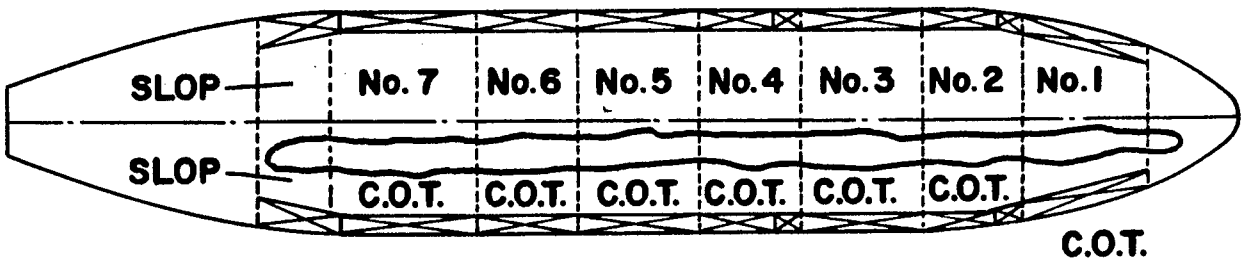
FIG_5(c)
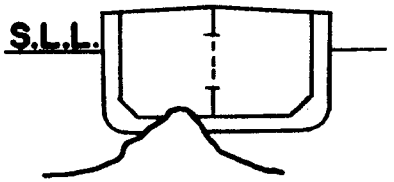
FIG_5(d)

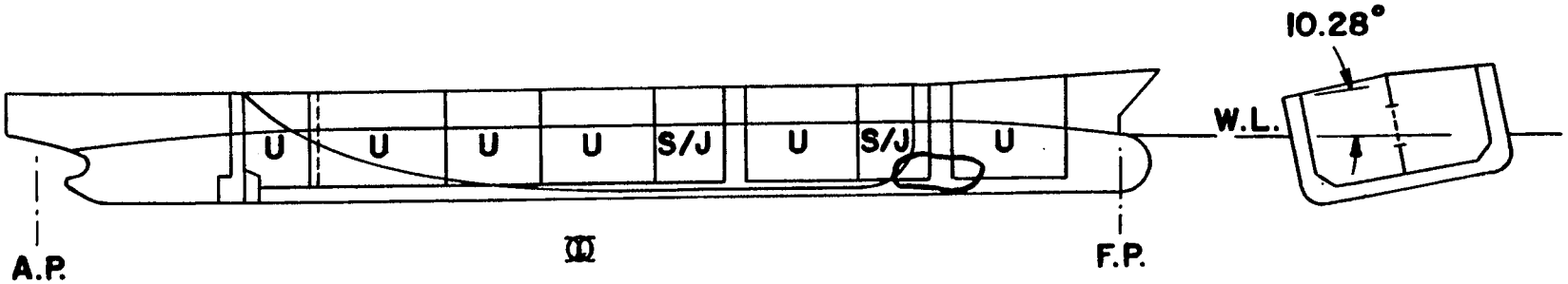
FIG_6(a)
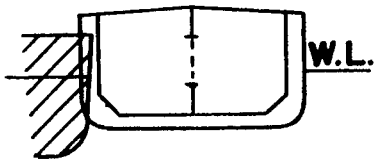
FIG_6(b)
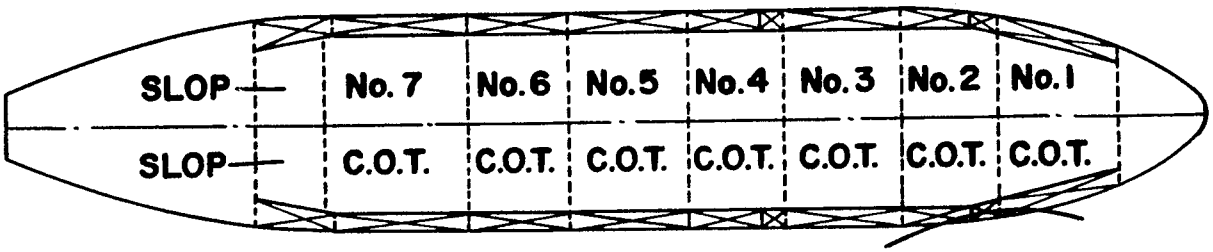
FIG_6(c)
FIG_6(d)

BALLAST TANK ELEMENTS FOR A DOUBLE HULL VESSEL

This application is a continuation of application Ser. No. 519,386, filed May 4, 1990, now abandoned.

The present invention relates to ballast tank elements for a double hull vessel.

BACKGROUND OF THE INVENTION

Single-skin hull vessels are usually used to transport liquid cargo, such as gasoline, crude oil and various other liquid chemicals. If the hull is breached from an accident, the leakage of liquid into the surrounding sea may cause pollution.

Because of the international furor created by oil spills, various schemes have been proposed to minimize the danger of leakage from oil carriers. Usually, the solution lies in a double hull vessel whose design is such that if an accident impairs the structure of the outer hull, the inner hull can be expected to retain its integrity and prevent leakage of the liquid cargo held therein.

Unfortunately, because the center of gravity of the load is higher in double hull vessels than in single hull vessels, double hull vessels are less stable. Even if only a few of the compartments of a double hull vessel are breached, depending upon the subdivision arrangement, the resulting imbalance of the load might capsize the vessel, and the whole vessel might be lost.

SUMMARY OF THE INVENTION

The present invention is a double hull vessel having improved survivability when damaged. This improved survivability results from novel ballast tank elements, each having (a) a half-breadth double-bottom ballast tank having a tank access trunk (a "J" unit) and (b) a side ballast tank located within the double-hull (a "S" unit). The tank access trunk of the "J" unit is located within the double-side of the hull, and the side ballast tank is next to the tank access trunk. The tank access trunk can be at least one frame space wide. Preferably, at least one pair of ballast tank elements are used, and these elements are adjacent and opposite from each other. These pair of ballast tank elements can be used with double-hull ballast tank elements having no internal subdivisions ("U" units).

An advantage of this arrangement is that it provides survivability in all damage conditions involving both inner and outer hulls in way of the cargo tank body while retaining an acceptable intact stability during loading and unloading of cargo and ballast water. This is illustrated in FIGS. 2 through 7, which compares an arrangement of the present invention with that of a more conventional "L, L, L, L, L, L, L, L," configuration.

Good access and ventilation of all ballast tanks is retained without the need to provide access trunks to the double bottom through cargo tanks.

Within this specification, we discuss different types of ballast tanks ("L," "J," "S," and "U"). A "L" unit is a ballast tank located within the double hull and having its inboard boundary at the center of the vessel and its outboard boundary at the upper deck level (shown in FIG. 1(*d*)). A "J" unit is half-breadth double-bottom ballast tank having a tank access trunk (shown in FIGS. 1(*a*) and 1(*c*)). A "A" unit is a side ballast tank located within the double-hull and is adjacent to the tank access trunk of the "J" unit (shown in FIG. 1(*a*) and 1(*c*)). A "U" unit is a double-hull ballast tank having no internal subdivisions (shown in FIG. 1(*b*)).

BRIEF DESCRIPTION OF THE DRAWINGS

In order to facilitate the understanding of this invention, reference will now be made to the appended drawings of the preferred embodiments of the present invention. The drawings are exemplary only, and should not be construed as limiting the invention.

FIG. 1(*b*) is a transverse section of a "U" unit.

FIG. 1(*c*) is a transverse section of a "J" unit and a "S" unit.

FIG. 1(*d*) is a transverse section of a "L" unit.

FIG. 2 is a schematic drawing of the computer simulation results showing limits of survivability of a double hull design having a "L, L, L, L, L, L, L, L," configuration under full load conditions.

FIGS. 3, 4 and 5 are schematic drawings of the computer simulation results showing limits of survivability of a double hull design having a "U, U, U, U, J/S, U, J/S, U" configuration under full load conditions and varying degrees of bottom damage.

FIGS. 6 and 7 are schematic drawings of the computer simulation results showing limits of survivability of a double hull design having a "U, U, U, U, J/S, U, J/S, U" configuration under 40% unloaded conditions, and varying degrees of side damage.

DETAILED DESCRIPTION OF THE PREFERRED EMBODIMENTS

In its broadest aspect, the present invention involves a double hull vessel that has improved survivability when damaged. That improved survivability is achieved by using a novel ballast tank element comprising a half-breadth double-bottom ballast tank having a tank access trunk (a "J" unit) and a side ballast tank located within the double-hull (a "S" unit). The tank access trunk of the "J" unit is located within the double-side of the hull, adjacent to the "S" unit. Together, the "J" unit and the "S" unit form the novel ballast tank element ("J/S" element) of the present invention.

THE "J" UNIT

The "J" unit is half-breadth double-bottom ballast tank having a tank access trunk. By "half-breadth," we mean half of the breadth (or beam) of the vessel. By "double-bottom," we mean the space enclosed by the inner and outer bottoms of the vessel. By "ballast tank," we mean a tank used solely for the carriage of water ballast.

The tank access trunk is located within the double-side of the hull, adjacent to the "S" unit. By "tank access trunk," we mean a watertight enclosure extending from an upper deck to the inner bottom level, which contains an access ladder. By "double-side of the hull," we mean the space enclosed between the inner and outer sides of the vessel. Preferably, the tank access trunk is at least one frame space wide. By "one frame space," we mean the space extending between one transverse web frame and the next forward or aft transverse web frame (or transverse bulkhead).

THE "S" UNIT

The "S" unit is a side ballast tank located within the double-hull and is adjacent to the tank access trunk of the "J" unit. By "side ballast tank," we mean a ballast tank located totally within the double side and extending from upper deck to inner bottom level.

THE "J/S" UNIT

Together, the "J" unit and the "S" unit form a "J/S" element that takes the same space as a conventional "L" unit. Preferably, these "J/S" ballast tank elements are used in pairs, wherein the elements are adjacent and opposite from each other.

THE "U" UNIT

Pairs of "J/S" units can be used with double-hull ballast tank elements having no internal subdivisions ("U" units). By "having no internal subdivisions," we mean having no longitudinal water tight structures dividing the tank internally.

Figure 1B:
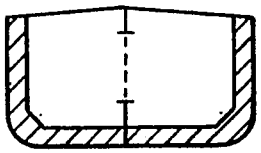
FIG. 1(*a*) is a schematic drawing of the ballast tank element of the present invention, having a half-breadth double-bottom ballast tank (a "J" unit) and a side ballast tank (a "S" unit).
Figure 1C:
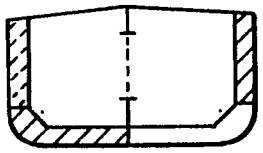
Figure 1D:
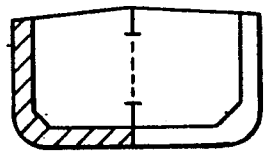
Figure 1A:
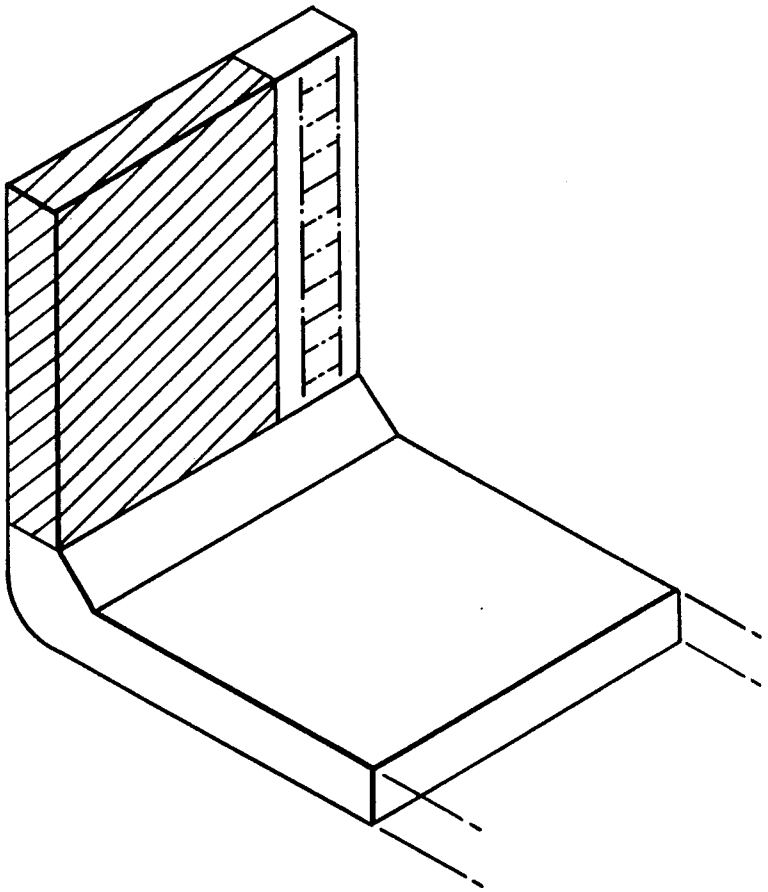
Figure 7B:
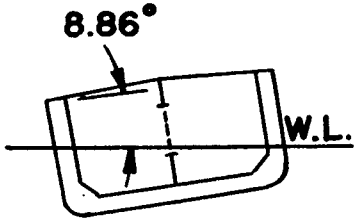
Figure 7D:
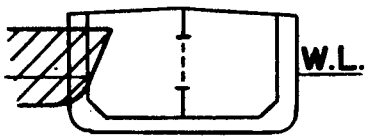
Figure 7A:
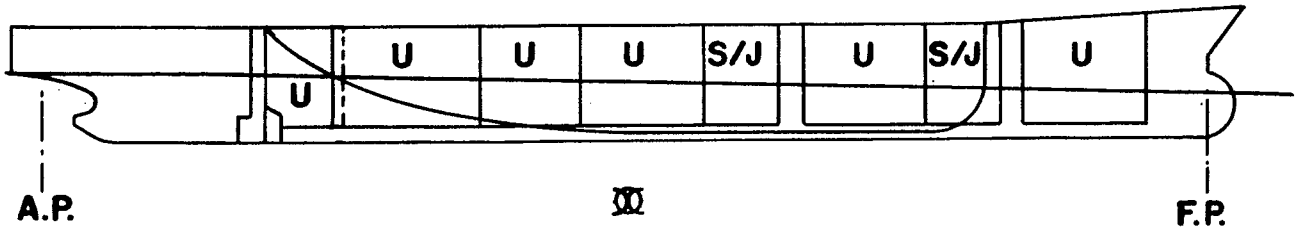
Figure 7C:
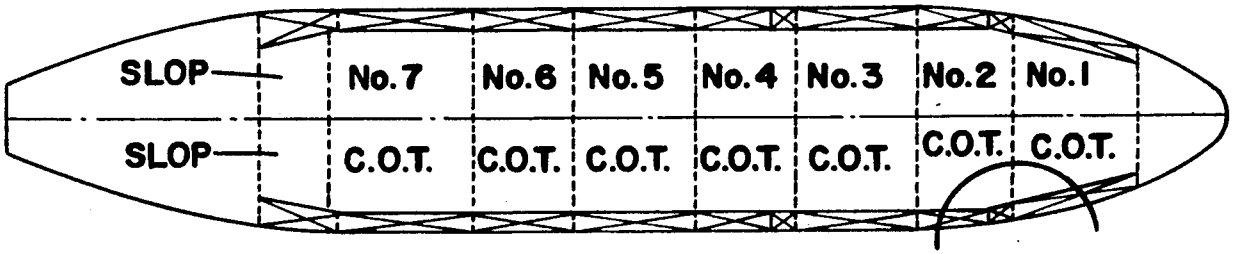

FIGS. 2 through 7 show computer simulation results comparing the survivability of a configuration of the present invention ("U, U, U, U, J/S, U, J/S, U") with that of a more conventional configuration ("L, L, L, L, L, L, L, L").

FIG. 2 shows that the conventional configuration under full load conditions could only survive bottom damage that pierces the outer hull of two tank elements. On the other hand, FIGS. 3, 4, and 5 show that, under the same load conditions, the configuration of the present invention could survive bottom damage that pierces the outer hull of all tank elements of one side of the ship (FIG. 3); bottom damage that pierces the outer hull of all tank elements along the bottom of the ship (FIG. 4); or bottom damage that pierces both the outer and the inner hull of all tank elements of one side of the ship (FIG. 5).

FIGS. 6 and 7 show that, under 40% unloaded conditions, the configuration of the present invention could survive a collision that pierces either only the outer hull or both the outer and inner hull of the first two units.

While the present invention has been described with reference to specific embodiments, this application is intended to cover those various changes and substitutions which may be made by those skilled in the art without departing from the spirit and scope of the appended claims.

What is claimed is:

1. A double hull vessel having a double-side of the hull and having at least one ballast tank element comprising:

(a) a half-breadth double-bottom ballast tank having a tank access trunk, (1) wherein said half-breadth double-bottom ballast tank is half of the breadth of the vessel, (2) wherein said tank access trunk is at least one frame space wide and wherein said tank access trunk contains an access ladder, and (3) wherein said tank access trunk is located within the double-side of the hull; and (b) a side ballast tank located within the double-hull; wherein the side ballast tank is adjacent to said tank access trunk.

2. A double hull vessel according to claim 1 comprising at least one pair of said ballast tank elements, wherein said elements are adjacent and opposite from each other.

3. A double hull vessel according to claim 1 comprising:

(a) at least one pair of said ballast tank elements, wherein said elements are adjacent and opposite from each other; and (b) double hull ballast tank elements having no internal subdivisions.

* * * * *